United States Patent [19]

Kehl

[11] Patent Number: 4,649,813

[45] Date of Patent: Mar. 17, 1987

[54] WASTE COMPACTOR APPARATUS

[76] Inventor: Charles W. Kehl, 11466 Irvington Dr., Warren, Mich. 48093

[21] Appl. No.: 775,646

[22] Filed: Sep. 13, 1985

[51] Int. Cl.[4] ..... B30B 15/06

[52] U.S. Cl. ..... 100/227; 100/245; 100/295; 220/1 T; 220/318; 220/337

[58] Field of Search ..... 100/240, 245, 295, 226, 100/227, 228, 246, 247, 248, 265, 229 A, 233; 220/1 T, 318, 337, 338, 340

[56] References Cited

U.S. PATENT DOCUMENTS

| | | | |
|---|---|---|---|
| 2,800,244 | 7/1957 | Witt . | |
| 2,802,590 | 8/1957 | Tupper . | |
| 3,113,692 | 12/1963 | Di Pierro | 220/338 |
| 3,585,781 | 6/1971 | Blee . | |
| 3,749,274 | 7/1973 | Mele et al. . | |
| 3,760,718 | 9/1973 | Adornetto . | |
| 3,854,582 | 12/1974 | Martinelli | 220/94 |
| 3,863,563 | 2/1975 | Popeil . | |
| 3,946,662 | 3/1976 | Ross, Jr. et al. . | |
| 4,331,074 | 5/1982 | Behman | 220/1 T X |
| 4,416,197 | 11/1983 | Kehl | 100/214 |

FOREIGN PATENT DOCUMENTS

| | | | |
|---|---|---|---|
| 72030 | 9/1916 | Switzerland | 220/337 |

*Primary Examiner*—Billy J. Wilhite

*Attorney, Agent, or Firm*—Harness, Dickey & Pierce

[57] ABSTRACT

An improved trash receptacle is provided according to this invention. The invention is particularly directed to trash containers of the type having a top assembly having a frame and a pivoting door which encloses a central opening of the frame. The improvement comprises a pivot means for the door including a pivot member and a socket which enable the door to be retained in its normal position by gravity, but which permits the door to be easily detached from the frame to enable it to be inserted into the trash container to compress material therein. Once the user has completed the compaction step, the door is re-engaged with the frame.

10 Claims, 8 Drawing Figures

WASTE COMPACTOR APPARATUS

TECHNICAL FIELD

This invention relates to a waste receptacle and particularly, to one having an integral manually operated compacting mechanism associated with the waste receptacle.

BACKGROUND OF THE INVENTION

Trash receptacles are found in all facets of life, including commercial and residential settings. Typically, refuse material is deposited directly into plastic bags or into a rigid container which may be lined with a plastic trash bag. Most refuse material is low in density, for example, paper, cardboard, and food waste products. Once the trash container or bag is filled, it is normally bundled and transported for disposal. Trash compacting devices are ordinarily not readily accessible and, therefore, trash normally occupies a much greater volume than would otherwise be necessary. As a result, when using plastic trash bags, a much greater number of these relatively expensive products must be used than is necessary in terms of their weight carrying and volume capacity. Trash receptacles, whether lined or unlined, must be emptied much more frequently than would be necessary if the trash were compacted while it is in the container. In order to overcome these problems, many homeowners and others using trash receptacles will attempt to compress the trash using their hands or feet. These methods are largely ineffective and have other obvious shortcomings. Another approach often used is to attempt to squeeze the material within a plastic trash bag after it is removed from the refuse container. When sharp articles such as empty cans, lids, etc. are in the trash bag, however, attempts to compact the material within the bag using this method often results in perforation of the bag.

Many devices for waste compaction are presently known. These devices, however, are generally electrically or hydraulically actuated machines which are quite expensive and are not suitable for installation at every location where trash receptacles are placed.

SUMMARY OF THE INVENTION

The shortcomings of waste disposal described above are solved by a trash compactor apparatus according to this invention. This invention is an improvement in existing trash receptacles of the type having a lower container and a top assembly with a pivotable door. According to this invention, the pivoting door assembly is normally held in engagement with the frame by gravity, but is easily detached from the top frame so that it can be forced downward into the trash container to compress the material inside. Thereafter, the door assembly is simply brought upward through the frame and replaced into its original engaged position with the top frame. This invention requires minimal modifications to existing trash receptacle designs and effectively compresses trash material without the expense and complexity of power operated equipment. By enabling more material to be placed within a plastic trash bag, a savings in terms of a reduction in the number of bags used is realized. Further, by increasing the density of the waste material, less space is needed to store the filled trash bags prior to the time when they must be removed for disposal. Additionally, the material within a plastic trash bag can be compressed without danger of perforation since the bag is supported by a relatively rigid trash container.

In a previous patent application filed by this inventor which resulted in issued U.S. Pat. No. 4,416,197 which is hereby incorporated by reference, I describe another means for providing a manually operated trash compactor. That invention, however, related to trash receptacles having a non-pivotable lid structure which must be removed from the lid frame to provide an opening to insert trash. In another application filed by this inventor, Ser. No. 621,500, filed June 18, 1984, now U.S. Pat. No. 4,593,615, further incorporated by reference, another means for providing a manually operated trash compactor is described. That invention, however, relates to trash receptacles with a pivotal door having retractable pivot means enabling the door to be disengaged from the frame to permit trash compaction.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
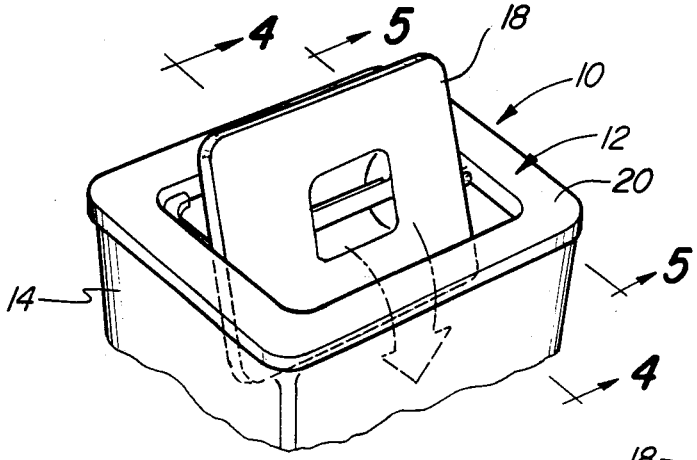
FIG. 1 is a perspective view of a waste compactor made in accordance with a first embodiment of the present invention illustrating the pivotal door in an open position.

A trash compactor, according to a first embodiment of this invention, is generally shown in FIGS. 1 through 5 and is designated by reference number 10. The waste compactor apparatus 10 includes top assembly 12 which is placed in registry with the exterior perimeter of container 14. A plastic bag 16 (not shown) may be inserted into the interior cavity of container 14. Bag 16 is firmly held in position by clamping engagement between top assembly 12 and container 14. Top assembly 12 is made up of two major components, door 18 and frame 20. Door 18 is pivotally attached to frame 20. This pivotable attachment enables door 18 to swing in frame 20 from a normal generally horizontal position to a pivoted position, as in shown in FIG. 1, which provides an opening for the insertion of trash.

In accordance with prior art trash container designs, the door is attached to the associated frame in such a way that it cannot be conveniently dismounted from the frame and forced into the inside of the trash container. However, in accordance with this invention, door 18 is easily and conveniently released from its pivotal engagement with frame 20, enabling it to be forced downwardly into container 14, as shown in phantom lines in FIG. 2, to compress the refuse therein. The provision of removable door 18 also enables insertion of large objects within container 14. In order to permit air which is trapped between plastic bag 16 and container 14 to escape while trash is compacted, the container may include the minor variation of forming a plurality of small holes (not shown). Thes holes further facilitate bag 16 removal by preventing an "air lock" in the lower portion of container 14. As a further minor variation, bag removal may be further facilitated by incorporating a foot support (not shown) into the container 14 such as an indentation or outwardly extending flange which the user steps on while removing the bag, thereby restraining the container.

Door 18 is preferably a substantially flat planar member. The shape and design of door 18 and frame 20, however, can vary in order that it may be adaptable to varying container designs. Door 18 includes handle 22, cup portion 24, weighted portion 26, and one or more pivots 28. Handle 22 and cup portion 24 are positioned such that a channel 30 is formed between the two, providing convenient grasping for the user. Cup 24 acts to protect the user from direct contact with articles in container 14. A minor variation, handle 22 can extend upwardly from the surface of door 18, thereby eliminating the necessity of forming cup portion 24. Perimeter flange 34 is provided to reinforce door 18.

Weighted portion 26 is formed on the underside of door 18. Weighted portion 26 may be an increased thickness section of door 18 or could be a separate component attached to door 18. Weighted section 26 adds extra weight to a portion of door 18 which brings the door back into its original horizontal position in frame 20, after the door has been swung open.

Pivots 28, positioned on the underside of door 18, define a convex shaped surface which are preferably cylindrical or partially cylindrical members. Pivots 28 may be directly connected to weighted portion 26 by linkage bars 27. Pivots 28 are secured to door 18 and thus, are non-retractable. Pivots 28 are positioned in sockets 32 in frame 20 for rotating door 18. Pivots 28 and socket 32 enable door 18 to be retained in its normal position by gravity such that the door is removed from frame 20 simply by lifting the door upwardly. Sockets 32 have a concave surface, and preferably a cylindrical surface complimenting pivots 28, for insertion of the pivots into socket 32.

Figure 4:
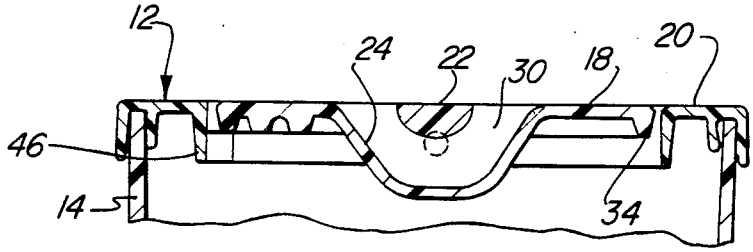
FIG. 4 is a cross-sectional view along lines 4—4 of FIG. 1.
Figure 5:
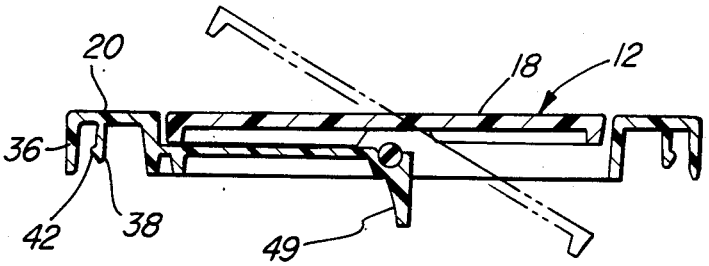
FIG. 5 is a cross-sectional view along line 5—5 of FIG. 1.

Frame 20 has a central opening 44 with a boundary flange 46 around the perimeter of the opening. Boundary flange 46 has one or more ledges 48 which extend into central opening 44. Ledges 48 retain door 18 in a generally horizontal position, thereby closing central opening 44. Stops 49, best shown in FIG. 5, are provided to prevent door 18 from rotating to a position past vertical so that the door will return to its normal closed position after it is moved for insertion of trash. Stops 49 may be formed so that they are connected to socket member 32. A pair of perimeter flanges 36 and 38 form channel 40 for securing the frame 20 to container 14, as seen in FIG. 4. Inner flange 38 has a projection 42 to firmly connect frame 20 to container 14. Flanges 36 and 38 pinch plastic bag 16 for retaining the bag in position during the compaction of waste materials.

Figure 2:
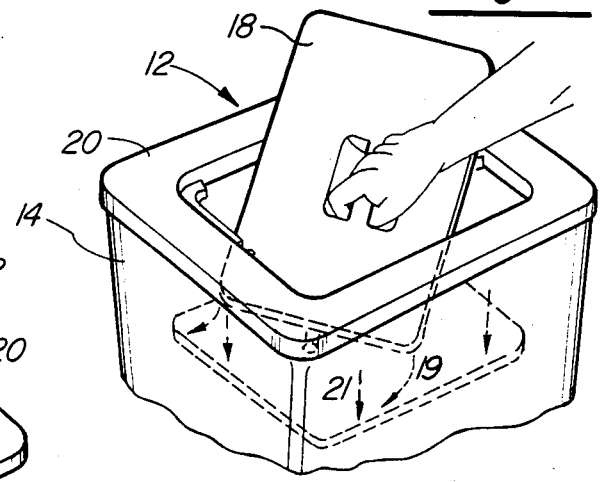
FIG. 2 is a perspective view of a waste compactor as shown in FIG. 1 illustrating the door being removed from the frame and inserted through the lid enabling compacting of the refuse in the container.
Figure 3:
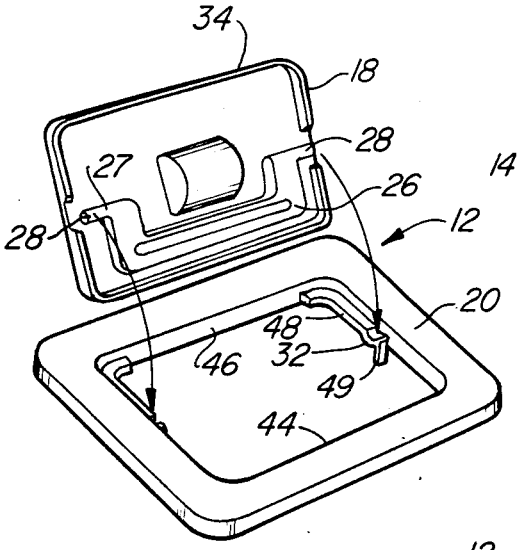
FIG. 3 is a perspective view of the bottom of the door of FIG. 1 illustrating the frame pivots.

Door 18 may be inserted into container 14 as follows. Door 18 is moved sideways (indicated by arrow 19) tipped slightly downward toward the inside of container 14 (as indicated by arrow 21) and inserted into container 14. The slight tipping is enough so that pivot 28 clears underneath socket 32. Thus, door 18 need not be rotated to the extent as illustrated in FIG. 2.

Figure 6:
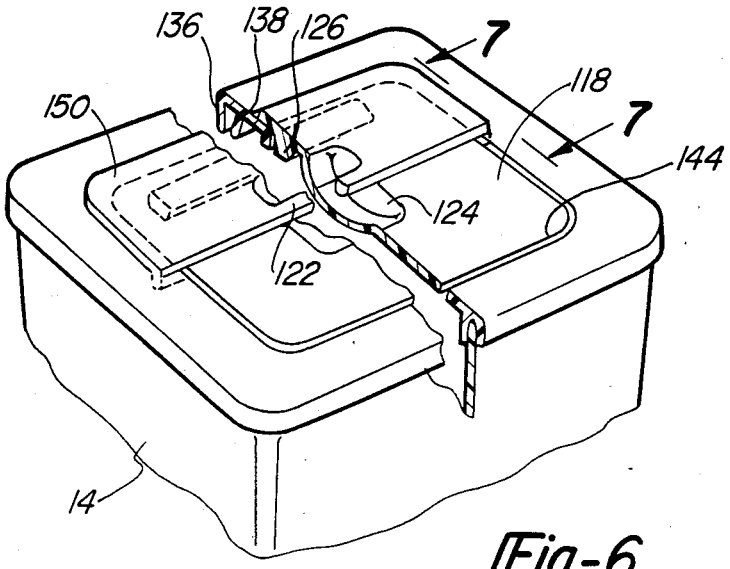
FIG. 6 is a perspective view, partially in cross-section, of a second embodiment made in accordance with the present invention.
Figure 7:
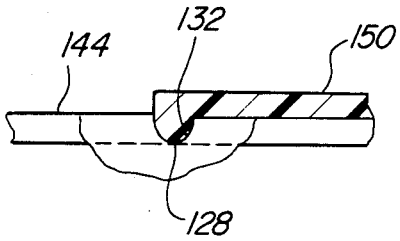
FIG. 7 is a partial cross-sectional view along line 7—7 of FIG. 6.
Figure 8:
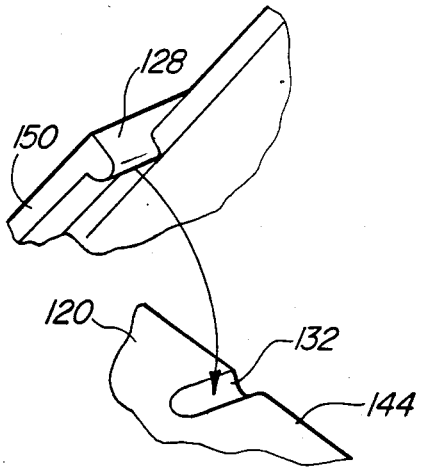
FIG. 8 is a perspective cut away view of the pivot shown in FIG. 6.

FIGS. 6 through 8 illustrate a second embodiment of the present invention. For this embodiment, door 118 has a lip 150 extending onto the top surface of frame 120. Lip 150 functions like ledge 48 of the first embodiment of the present invention to position door 118 to enclose central opening 144. Lip 150 preferably encompasses approximately one-half of the perimeter of door 118. Lip 150 includes pivots 128, which are mounted into sockets 132 on frame 120. Pivots 128 have a convex surface and are positioned on the terminal edge of lip 150. Sockets 132 are positioned in frame 120 and have the complementary shape of pivots 128. Thus, by having lip 150 on door 118, the central opening 144 does not have members extending into its center from boundary flange 146. Handle portion 122, cup portion 124, weighted portion 126, flanges 136 and 138, and projection 142 function like the corresponding elements of the first embodiment. These elements, therefore, will not be discussed in detail due to the duplicative nature of the discussion.

While the above description constitutes the preferred embodiments of the present invention, it will be appreciated that the invention is susceptible to modification, variation and change without departing from the proper scope and fair meaning of the following claims.

What is claimed is:

1. An improved top assembly for a trash receptacle of the type having a frame attachable to the open perimeter of a container, said frame having a central opening, said top assembly further having a door for opening or closing said central opening attached to said frame for pivoting movement, said top assembly comprising:

pivot means for mounting said door to said frame including a pivot member having a generally convex surface which is received by a socket having a generally concave surface, said pivot member and said socket being retained by gravity in a normal usage condition which enables said door to be pivoted between closed and opened positions, said pivot member and said socket enabling said door to be lifted, thereby disengaging said pivot member from said socket whereby said door can be inserted through said central aperture to compress material in said container, and handle means formed by said door enabling said door to be grasped by a user.

2. The improved top assembly according to claim 1 wherein said door defines said pivot member and said frame defines said socket.

3. The improved top assembly according to claim 1 wherein a first stop means is positioned on said frame for limiting rotational movement of said door and for supporting said door in said closed position.

4. The improved top assembly according to claim 3 wherein said door has a means for urging said door to remain in said closed position and supported by said first stop means.

5. The improved top assembly according to claim 4 wherein said means for urging said door comprises said door having a center of gravity displaced from the axis of rotation of said door defined by said pivot means such that said door is urged to remain in said closed position by gravity.

6. The improved top assembly according to claim 3 wherein said first stop means is defined by ledges connected to said frame and extending into said central opening.

7. The improved top assembly according to claim 3 further comprising second stop means for limiting the extent of angular travel of said door about said pivot means from said closed position to said opened position.

8. The improved top assembly according to claim 7 wherein said second stop means comprises at least one projection extending from said frame adjacent said socket and positioned to come into contact with said door when said door is moved from said closed position to said opened position.

9. The improved top assembly according to claim 3 wherein said first stop means is defined by a lip connected to said door and abutting said frame when said door is in said closed position.

10. The improved top assembly according to claim 1, wherein said handle means comprises a handle member and a cup portion partially surrounding said handle member thereby defining a channel formed between said cup portion and said handle member for providing access for a user's hand around said handle member and for protecting the user from contacting trash material when said door is compressing waste material.

* * * * *